US005795410A

United States Patent [19]

Liu

[11] Patent Number: 5,795,410

[45] Date of Patent: Aug. 18, 1998

[54] CONTROL OF SURFACE CARBIDES IN STEEL STRIP

[75] Inventor: Yinshi Liu, Monroeville, Pa.

[73] Assignee: USX Corporation, Pittsburgh, Pa.

[21] Appl. No.: 788,092

[22] Filed: Jan. 23, 1997

[51] Int. Cl.[6] ..... C22C 38/18

[52] U.S. Cl. ..... 148/320

[58] Field of Search ..... 148/652, 654, 148/320

[56] References Cited

U.S. PATENT DOCUMENTS

| | | | |
|---|---|---|---|
| 946,360 | 1/1910 | Hodgkinson . | |
| 1,934,313 | 11/1933 | Lauenstein | 148/21.8 |
| 2,300,792 | 11/1942 | Lomax | 148/21.5 |
| 2,417,760 | 3/1947 | Keene | 148/21.5 |
| 2,804,413 | 8/1957 | Essig et al. | 148/19 |
| 2,821,494 | 1/1958 | Walker | 148/16.5 |
| 3,437,477 | 4/1969 | McCune | 75/128 |
| 3,871,928 | 3/1975 | Smith, Jr. et al. | 148/142 |
| 4,099,993 | 7/1978 | Muller et al. | 148/14 |
| 4,313,770 | 2/1982 | Takahashi et al. | 148/652 |
| 4,358,046 | 11/1982 | Detz et al. | 228/176 |
| 4,381,955 | 5/1983 | Desai | 148/20.3 |
| 5,085,712 | 2/1992 | Watanabe et al. | 148/2 |
| 5,096,515 | 3/1992 | Kawamura et al. | 148/326 |
| 5,106,435 | 4/1992 | Hudson | 148/253 |
| 5,186,768 | 2/1993 | Nomoto et al. | 148/580 |
| 5,192,485 | 3/1993 | Kuramoto et al. | 266/80 |
| 5,445,685 | 8/1995 | Strum et al. | 148/324 |
| 5,498,299 | 3/1996 | Schmidt | 148/210 |

FOREIGN PATENT DOCUMENTS

| | | |
|---|---|---|
| 48-4293 | 2/1973 | Japan . |
| 57-73125 | 5/1982 | Japan . |
| 9614444 | 5/1996 | WIPO . |

*Primary Examiner*—Deborah Yee
*Attorney, Agent, or Firm*—William F. Riesmeyer, III

[57] ABSTRACT

A method is provided for reducing the size and area coverage of surface carbides formed during the box annealing of steel strip. In one aspect the method includes providing a casting consisting essentially of, by weight percent, 0.08% max. carbon, 1.0% max. manganese, 0.06% max. aluminum, up to 0.1% max. chromium, up to 0.1% max. titanium, up to 0.1% max. niobium and up to 0.1% max. vanadium. The casting is hot rolled to strip and then cold rolled. After cold rolling the strip is box annealed at a temperature above the $A_1$ temperature. The strip is cooled from the $A_1$ temperature such that the rate of cooling is at least 30° C./hour through the range of from about 727° C. to about 700° C. In another aspect the invention includes casting a steel of the aforementioned composition wherein the vanadium is at least 0.015%. The invention includes steel products made according to the methods just described.

5 Claims, 6 Drawing Sheets

MORPHOLOGY OF SURFACE CARBIDE ON THE STEELS WITH Cr ADDITION THE AREA OF THE SURFACE CARBIDE DEFINED BY THE LIGHT BOUNDARY

MORPHOLOGY OF SURFACE CARBIDE ON THE STEELS WITH V ADDITION THE AREA OF THE SURFACE CARBIDE IS DEFINED BY THE LIGHT DENDRITE

CONTROL OF SURFACE CARBIDES IN STEEL STRIP

TECHNICAL FIELD

The present invention is of a method for controlling the formation of surface carbides in steel strip which occurs during box annealing, and particularly to a method for reducing the size of surface carbides that form and the extent of the surface area of the strip on which surface carbides form during the box anneal. The method includes heating the steel strip to a temperature above the $A_1$ temperature, holding the strip at a temperature above the $A_1$ temperature, cooling the strip at a rate of at least about 30° C./hour in the range of 727° C. to 700° C. upon cooling from the $A_1$ temperature depending upon the length of soak time above the $A_1$ temperature, and/or adding vanadium in an amount of at least 0.015 weight % to the steel.

BACKGROUND ART

Surface carbides as large as 300 microns can form on low carbon steel sheet and strip during batch annealing under certain conditions. When the surface carbides are of a size greater than 50 microns they cause adhesion problems in metallic coatings and the formation of blisters in paint during the baking of painted electrogalvanized strip. The severity of these problems increases as the size of the surface carbides increases. In the prior art attempts have been made to control surface carbide formation by annealing at temperatures below the lower critical temperature. While this prevents the formation of surface carbides, it has the disadvantage that it reduces productivity due to the longer annealing time required. It also results in the strip having lower formability than strip which is annealed above the lower critical temperature. And finally, control of annealing temperature is difficult in commercial furnaces. Since it is desirable to anneal as close to the lower critical temperature as possible when a sub-critical annealing practice is used, various spots of steel coils being so annealed may exceed the lower critical temperature and cause surface carbides to form and grow in those higher temperature portions of the coil. Another approach used in the prior art has been to add chromium to the steel. However, chromium additions do not prevent surface carbide formation under all annealing conditions. Still another approach has been to apply a phosphate coating to the steel before it is annealed. A practice of this type is described in U.S. Pat. No. 5,106,435 of common ownership with the present application. The application of a coating requires a separate operation and additional cost.

A laid-open Japanese application JP 48-4293 discloses a low carbon steel product having high stress corrosion cracking resistance. The steel contains 0.07–0.35% C., 0.015–0.50% Si and is heated to a temperature range of $A_1$+30° C. to $A_3$, substantially in a range from 750° C. to 810° C. for 10 minutes or longer, then cooled at a rate greater than 100° C./hr., to avoid spheroidal carbide. Another Japanese laid-open application JP 57-73125, discloses a low carbon steel which may contain 0.04–0.80% Cr, 0.0005–0.0030% B and/or 0.02–0.04% V and which is box annealed at a sub-critical temperature and then hot-dip zinc coated. U.S. Pat. No. 5,556,485, discloses a hot rolled or cold rolled and annealed sheet or strip steel containing an effective amount of vanadium within the range of 0.005–0.6 %, to improve bake-hardenability. The reference states that the steel may be annealed in either batch form or in a continuous fashion. Specific examples of three steel compositions with vanadium ranging from 0 to 0.094% and which have been annealed for 30 seconds are provided to show an increase in bake hardenability of approximately 3 ksi for the vanadium steel over the non-vanadium steel

SUMMARY OF THE INVENTION

According to one aspect of this invention a method is provided for reducing the size and surface area of carbides formed on the surface of low-carbon steel strip during batch or box annealing. The method includes casting a steel consisting essentially of, in weight percent, 0.08% max. carbon, 1.0% max. manganese, 0.06% max. aluminum, up to 0.1% max. chromium, up to 0.1% max. titanium, up to 0.1% max. niobium, and up to about 0.1% max. vanadium, hot rolling the cast steel to strip, cold rolling the hot rolled strip and box annealing the cold steel rolled strip at a temperature above the $A_1$ temperature, said box annealing step including cooling the steel strip at a rate not less than about 30° C./hour, preferably at a rate of at least about 195° C./hour, through the temperature range of from about 727° C. to about 700° C., whereby the surface carbides formed in the steel strip during box annealing are reduced in size and in surface area. Preferably the method includes limiting the soaking time at a temperature above the $A_1$ temperature to about two hours maximum if the cooling rate is at about the lower limit of 30° C./hour through the temperature range of 727° C. to 700° C. When the soak time at temperature above the lower critical is so limited, it may be necessary to hold for a soak time at a temperature below the lower critical temperature in order to obtain the desired grain size and mechanical properties. In this case the soak at lower temperature is carried out after rapid cooling through the 727° C. to 700° C. temperature range. A steel strip produced by the method and having surface carbides of a size less than 50 microns is also provided. In another aspect of the invention a method is provided for reducing the size and area of carbides formed on the surface of steel strip, said method comprising casting a steel consisting essentially of 0.08% max. carbon, 1.0% max. manganese, 0.06% max. aluminum, up to 0.1% max. chromium, up to 0.1% max. titanium, up to 0.1% max. niobium, and 0.015% min. to about 0.1% max. vanadium, hot rolling the cast steel to strip, cold rolling the hot rolled steel strip, and box annealing the cold rolled steel strip at a temperature above the $A_1$ temperature, whereby the steel strip has surface carbides of a size substantially less than a comparable steel not containing vanadium. A steel strip processed according to the method and having surface carbides of a size no greater than 50 microns is also provided.

DESCRIPTION OF THE PREFERRED EMBODIMENT

Figure 1:
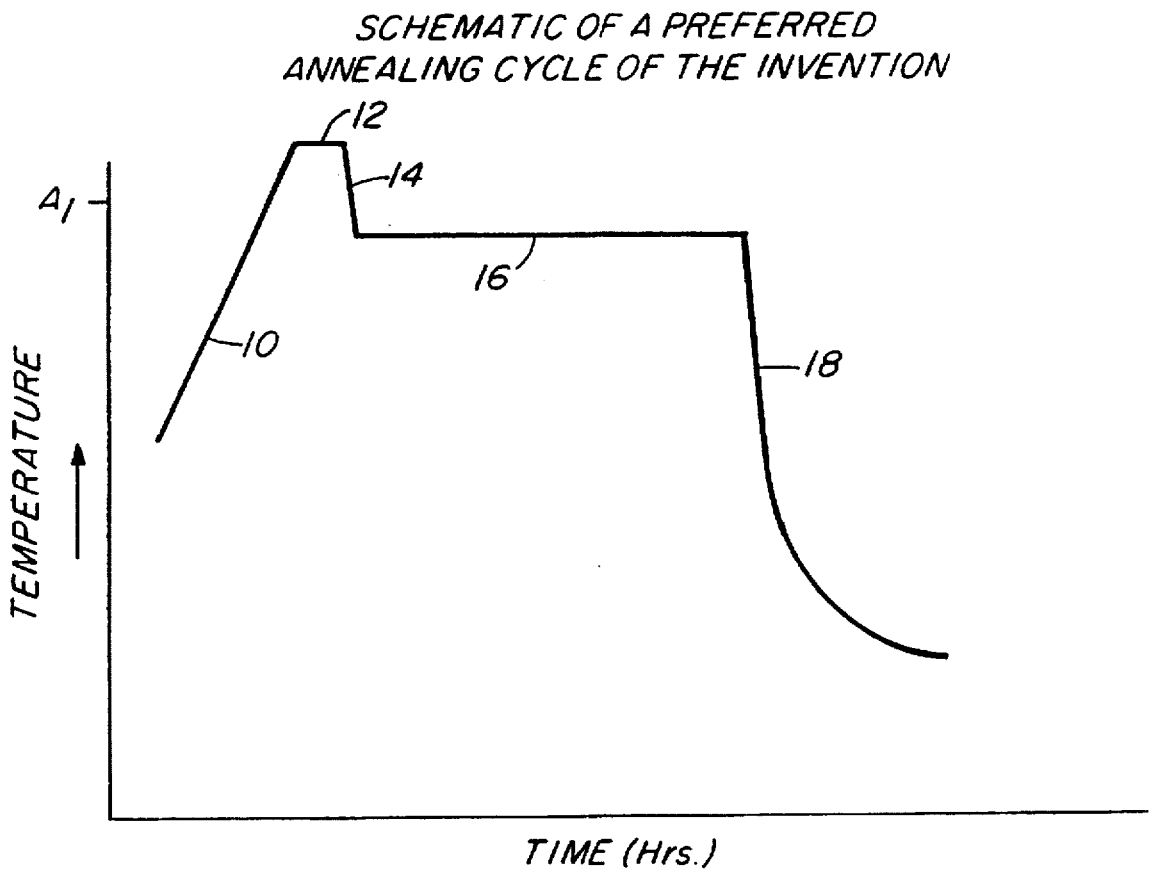
FIG. 1 is a schematic representation of an annealing cycle according to the method of the present invention.

In a first aspect of the invention, a steel casting is provided consisting essentially of, by weight percent, 0.08% max. carbon, 1.0% max. manganese, 0.06% max. aluminum, up to 0.1% max. chromium, up to 0.1% max. titanium, up to 0.1% max. niobium, and up to 0.1% max. vanadium, the balance iron and incidental impurities. The casting is hot rolled and cold rolled to strip form according to conventional practice. After cold rolling the strip is box annealed by heating to a temperature above the $A_1$ lower critical temperature. Upon cooling from that temperature, the cooling rate is controlled so that the strip is cooled at a rate of at least about 30° C./hour, preferably at a rate of at least about 195° C./hour, through the temperature range of 727° C. to 700° C. Preferably the soak time for which the strip is held at the temperature above the A1, is limited to not more than about two hours if the cooling rate is at about the lower limit of 30° C./hour through the temperature range of 727° C. to 700° C. When the soak time is so limited, it may be necessary to soak at a temperature below the $A_1$ temperature in order to obtain the desired grain size and mechanical properties after cooling through the above-mentioned 727° C. to 700° C. temperature range. Subsequent cooling may be at a conventional rate, but preferably may be at the faster rate just mentioned. A schematic representation of the heating and cooling cycle just described is shown in FIG. 1. In that Figure, the heating portion of the cycle is illustrated at 10. The strip is heated to a temperature above the A1 and held at the temperature above the A1 for a soak time of not more than about two hours as shown at 12. The strip is then cooled rapidly at a rate of not less than about 30° C./hour through the temperature range of 727° C. to 700° C. as shown at 14 in the Figure. Subsequently the strip is held at a soak temperature below the A1 temperature until the desired grain size and mechanical properties are obtained. This soak is illustrated at 16 in FIG. 1. Finally the strip is cooled at a convenient rate as at 18. If the cooling rate throughout the temperature range of 727° C. to 700° C. is substantially greater than 30° C./hour, the soak time above the $A_1$ temperature may be longer than two hours and the sub-critical temperature soak may not be required.

Figure 2:
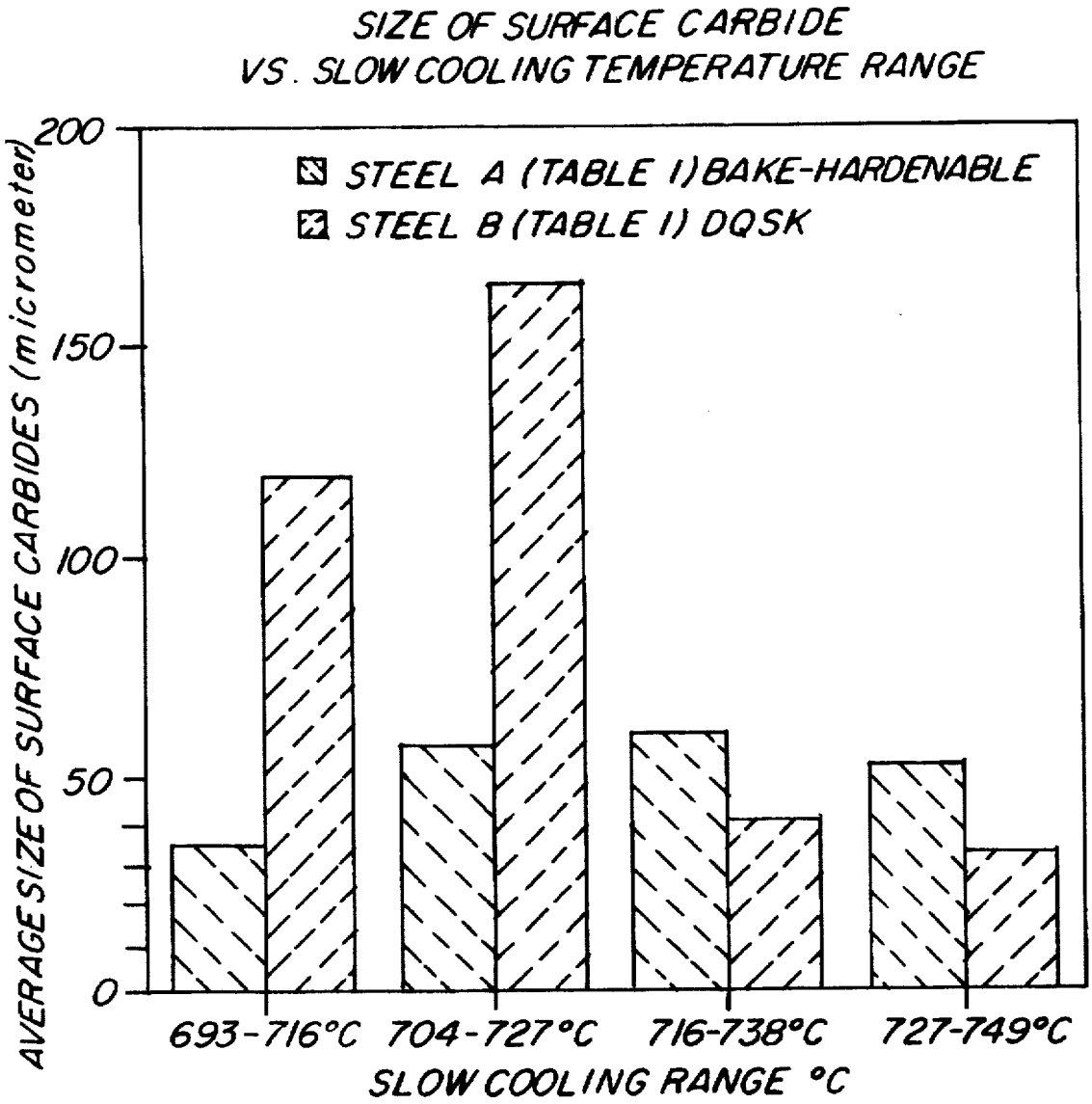
FIG. 2 is a bar graph showing the effect of slow cooling in various temperature ranges on the average size of surface carbides formed in box annealed steel strip.

To show the effect of cooling rate on the size of surface carbides formed, various sample specimens of two steels of compositions set forth in Table 1 were heated in a laboratory furnace to a temperature of 760° C., soaked at that temperature for 7 hours and cooled at a rate of 1.7° C./hour (3° F./hour) through the temperature ranges listed in FIG. 2. The cooling rate of each specimen through the other portion of the temperature range listed in FIG. 2 was 27.8° C./hour (50° F./hour) until a temperature of 649° C. (1200° F.) was reached and then cooling below that temperature was at a rate of 197° C./hour (355° F./hour). FIG. 2 shows that the average size of surface carbides formed is the greatest in the 727°C. to 704°C. temperature range. It also shows that the samples slow cooled at a rate of 1.7° C./hour through a temperature range of 749–727° C. and then cooled more rapidly at a rate of 27.8° C./hour to about 649° C. have a surface carbide size less than 50 microns. Similarly, it shows that the samples slow cooled through a temperature range of 738–716° C. and then cooled at a rate of 27.8° C./hour to 649° C. have a carbide size somewhat greater than 50 microns for Steel A and somewhat less than 50 microns for Steel B. Accordingly, it appears that a cooling rate of at least about 30° C./hour is necessary to assure attainment of a surface carbide size less than 50 microns for a wide range of steel compositions. It will be shown later in Table 2 that a faster cooling rate permits the use of a longer soak time at a temperature above the $A_1$ while still achieving an average size of surface carbide of less than 50 microns. To assure that the cooling rate will be at least 30° C./hour throughout a commercial coil of steel strip it may be necessary to have a much greater cooling rate as measured on the surface of the outer wraps of the coil. Table 2 below shows that the average surface carbide size achieved is well below 50 microns when the cooling rate in the temperature range of 727° C. to 700° C. is increased to 195° C./hour for Steel B. A cooling rate of as much as about 195° C./hour may be necessary on the outer wraps of the coil to assure achieving the 30° C./hour rate on an inner portion of the coil. It also appears that the faster the cooling rate the smaller the size of surface carbides obtained. Therefore, the faster cooling rates are more preferred.

TABLE 1

Composition in weight percent

| Element | Steel A | Steel B |
|---|---|---|
| C | .029 | .038 |
| Mn | .21 | .30 |
| P | .064 | .010 |
| S | .006 | .011 |
| Si | .021 | .015 |
| Cu | .018 | .020 |
| Ni | .020 | .016 |
| Cr | .073 | .024 |
| Al | .045 | .045 |
| N | .005 | .005 |

TABLE 2

Effect of Cooling Rate in the Temperature Range of 727° C. to 704° C. on the Average Size of Surface Carbides for a Steel Similar to Steel B in Table 1

| Soak Time at 747° C. (hours) | Cooling Rate through 727° C. to 704° C. (°C./hour) | Average Size of Surface Carbide (microns) |
|---|---|---|
| 10 | 1.7 | 183 |
| 10 | 27.8 | 25 |
| 21 | 195 | 12 |

Figure 3:
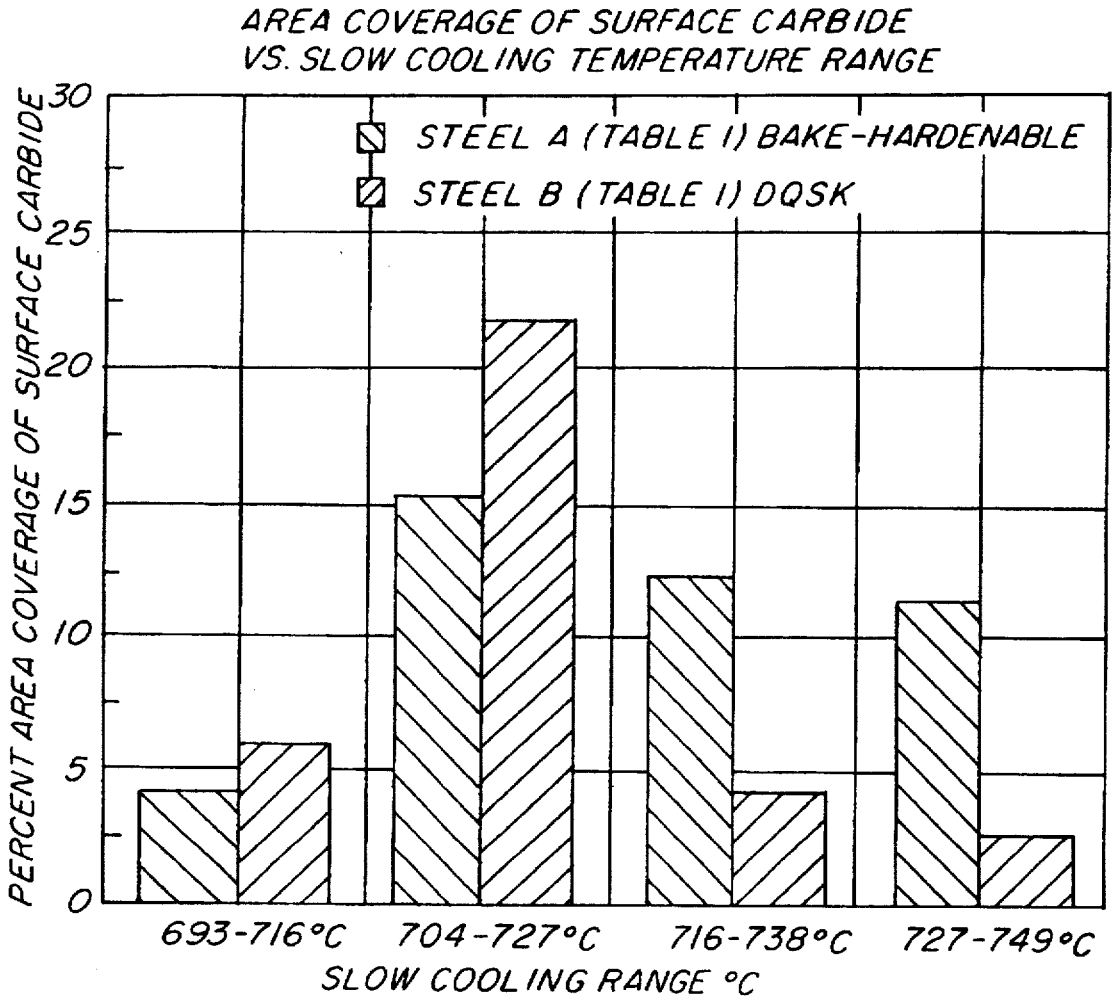
FIG. 3 is a bar graph showing the effect of slow cooling in various temperature ranges on the average area coverage of surface carbides formed in box annealed steel strip.

Similar results are shown in FIG. 3 in which it appears that 27.8° C./hour cooling rate has about the same effect, i.e. reducing the area of surface carbide coverage for Steel B. An even greater cooling rate would appear to be necessary for significantly reducing the surface carbide area of Steel A. Therefore a cooling rate of at least about 30° C./hour is required to achieve reduction in the area of surface carbides on most steels.

Figure 4:
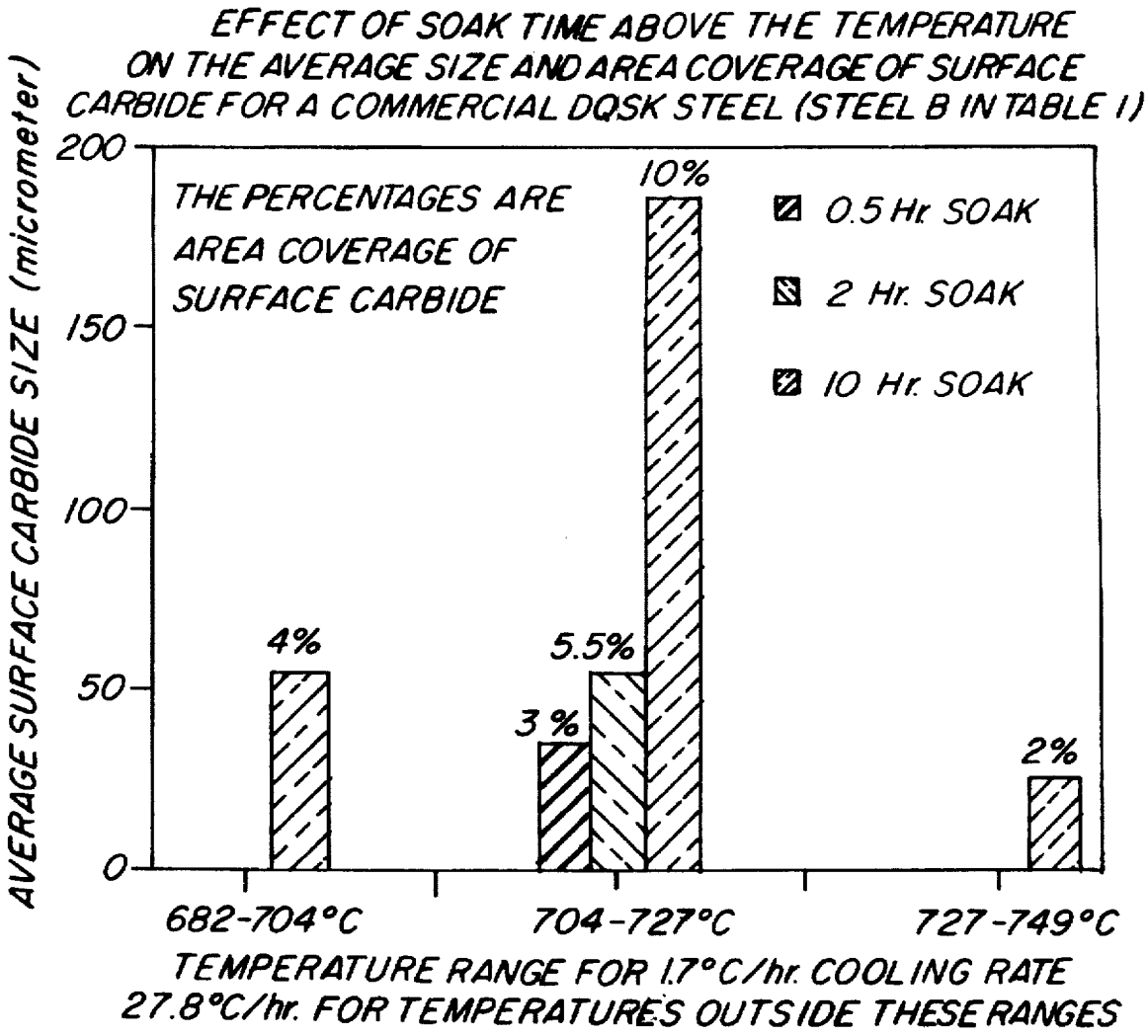
FIG. 4 is a bar graph showing the effect of soak time above the lower critical temperature on the average size and area coverage of surface carbide in box annealed steel strip

The effect of soak time above the lower critical temperature on the size and area of surface carbide is shown in FIG. 4. The composition of the steels tested are shown in Table 1. Again the cooling rate of each specimen was 1.7° C./hour (3° F./hour) within each particular temperature range listed and 27.8° C./hour (50° F./hour) outside that range. The 30 minute soak time provided the smallest size and surface area of carbide as compared to the longer soak times.

In a second aspect of the invention, small amounts of vanadium added to the steel have been found to decrease the size and surface area of carbides formed on the surface of the strip even at 1.7° C./hour slow cooling rates through the previously mentioned temperature range of 727° C. to 704° C. Three heats of the compositions set forth in Table 3 below were melted in the laboratory, two of which had vanadium added in an amount of 0.045% and 0.08%, respectively.

TABLE 3

| Element | Steel A | Steel B | Steel C |
|---|---|---|---|
| | Composition in weight percent | | |
| C | 0.022% | 0.025% | 0.025% |
| Mn | 0.20 | 0.20 | 0.20 |
| P | 0.07 | 0.075 | 0.082 |
| s | 0.008 | 0.010 | 0.009 |
| Si | 0.06 | 0.074 | 0.097 |
| Cu | 0.007 | 0.008 | 0.008 |
| Ni | 0.011 | 0.012 | 0.012 |
| Cr | 0.025 | 0.027 | 0.027 |
| Mo | <0.005 | 0.010 | 0.007 |
| V | <0.005 | 0.045 | 0.080 |
| Ti | 0.002 | 0.003 | 0.003 |
| Al | 0.034 | 0.030 | 0.020 |
| Cb | <0.005 | 0.010 | 0.011 |

Cold rolled sheets produced from these heats were annealed with an annealing cycle shown in Table 4. Steels A and C were temper rolled 0.5% and steel B was temper rolled 1% after annealing. Subsized tensile samples of ASTM standard were cut from the temper rolled sheet and prestrained 2%. The prestrained samples were then baked at 177° C. for 20 minutes. Tensile tests were run on the baked tensile samples. The results of the tensile tests are shown in Table 5. The vanadium additions reduced the size and surface area of surface carbides formed on the samples. The results also show that there was no significant difference between the bake hardenability of the samples containing no vanadium and 0.045% vanadium. However, the bake-hardenability of the sample containing 0.08% vanadium was adversely effected and was marginal.

TABLE 4

| Heating/Cooling (−) Rate °C./hour | Temperature Range °C. | Time hours |
|---|---|---|
| 83.6 | 21.1–316 | 3.5 |
| 33.1 | 316–760 | 10.4 |
| 0 | 760 | 7.0 |
| −27.8 | 760–727 | 1.2 |
| −1.7 | 727–704 | 13.3 |
| −27.8 | 704–649 | 2.0 |
| −196.8 | 649–21.1 | 3.2 |

TABLE 5

| Variable | Steel A | Steel B | Steel C |
|---|---|---|---|
| Yield Strength 0.2% (ksi) | 32.0 | 37.3 | 46.7 |
| Bake hardening (ksi) | 5.6 | 6.0 | 1.6 |
| Average Size of Surface Carbides (microns) | 97 | 22 | 13 |

TABLE 5-continued

| Variable | Steel A | Steel B | Steel C |
|---|---|---|---|
| Calculated (%)* Area Coverage of Surface Carbide | 4.1 | <2.6 | <0.9 |

*A precise evaluation of the area of carbide coverage as viewed through a microscope would require the individual measurement of a statistically significant number of particles and the calculation of the area of each particle. A reasonable measure of the amount of carbide may be obtained from a measure of the mean size of the more dominant size in a given field of view and the number of particles in that field of view. If a metric scale is used to measure the mean size, such that one unit or division of the scale is one millimeter at 100× magnification, then the percent Area (% A) of surface carbide may be calculated from the formula:

$$\% A = 71.9 \times N/a \times (S/M)^{1.928}$$

where N = the number of carbides of the dominant size in the field of view
a = the area of the field of view of the microscope being used, at the magnification M
S = the mean size of carbide equal to the number of units of the eyepiece scale
M = the magnification being used.

Figure 5:
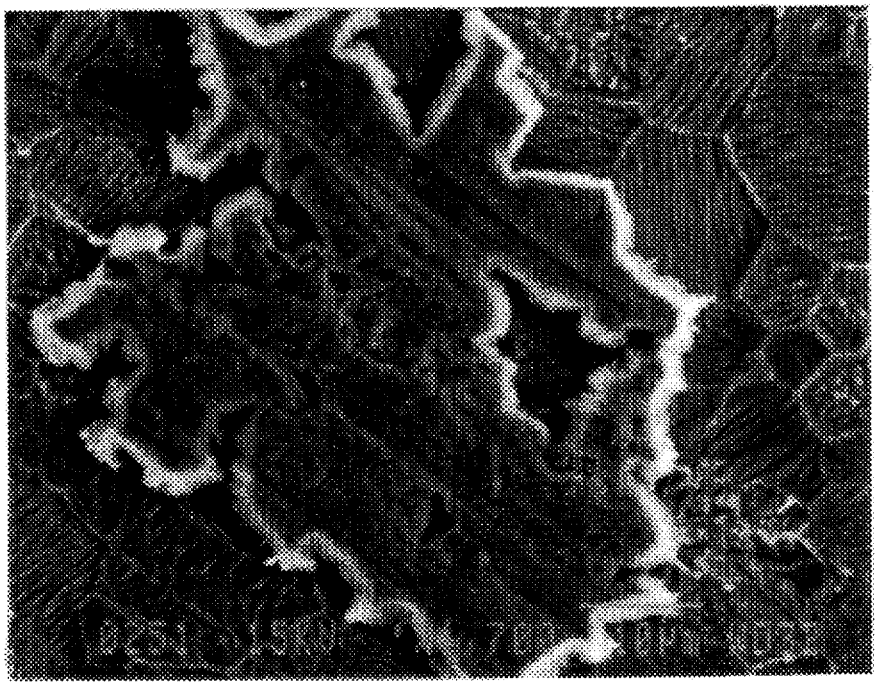
FIG. 5 is a photomicrograph of surface carbide on steel with a chromium addition.
Figure 6:
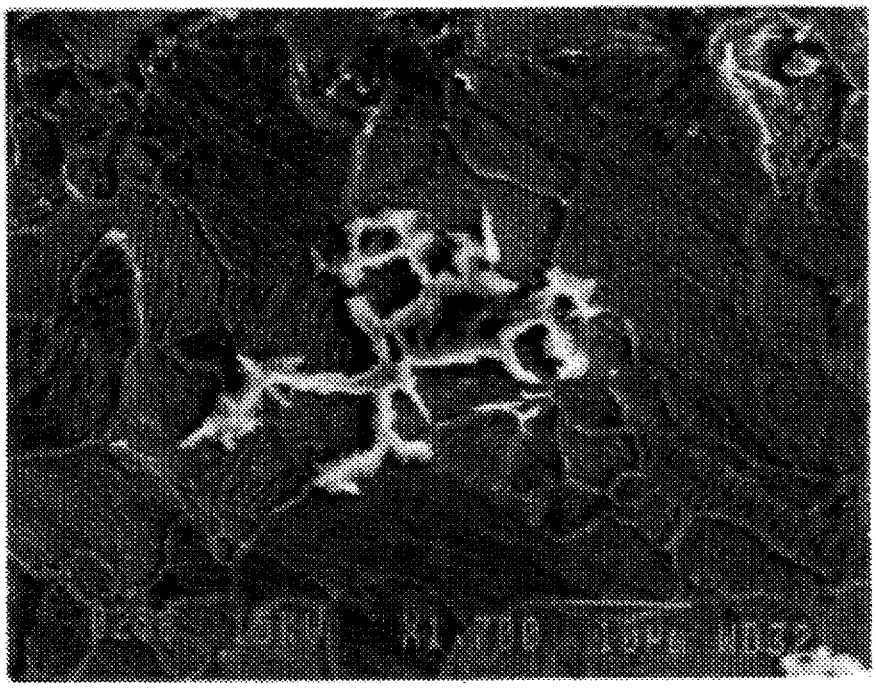
FIG. 6 is a photomicrograph of surface carbide on steel with a vanadium addition.

The actual coverage for the vanadium steel should be much smaller than the value calculated from photomicrographs due to the dendritic morphology of surface carbides in those steels rather than the patch morphology of surface carbides in steels not containing vanadium. FIG. 5 shows a photomicrograph of surface carbide in a steel containing a chromium addition of 0.073% which has a patch type of morphology. FIG. 6 shows the dendritic type morphology of surface carbide in a steel containing a vanadium addition of 0.045%. It is apparent that the surface carbide in the vanadium steel covers a much smaller surface area than that of the chromium steel.

The results shown in Table 5 indicate that there is essentially no difference in the bake-hardenability of the box annealed steel containing no vanadium and the steel containing 0.045% vanadium. In other words vanadium has no favorable effect on the bake-hardenability of box annealed steel. on the contrary, vanadium over about 0.05% decreases the bake-hardenability of box annealed steel. Therefore, the vanadium content of steel which is to be box annealed for bake-hardenable applications should be limited to about 0.05% max. In a most preferred form, the invention involves providing a steel containing at least 0.015% vanadium, limiting the soak time at a temperature above the $A_1$ temperature, and cooling the steel at a rate of at least 30° C./hour, preferably at a rate of at least about 195° C./hour, through the temperature range of 727° C. to 700° C. Thus steel products are provided for automotive and other applications where surface characteristics are critical, which have surface carbides of a size less than 50 microns.

I claim:

1. A steel strip for automotive applications with critical surface requirements, said steel strip having been produced by a method comprising:

casting a steel consisting essentially of in weight percent,
0.08% carbon max.
1.0% manganese max.
0.06% aluminum max.
up to 0.1% chromium max.
up to 0.1% titanium max.
up to 0.1% niobium max., and
up to 0.1% vanadium max.

hot rolling the casting to strip cold rolling the strip, and box annealing the cold rolled strip in coil form, including heating the strip to a temperature above the $A_1$ temperature, holding the steel strip at a temperature above the $A_1$ temperature for a time not in excess of about 30 minutes, and cooling the strip at a rate of at least about 30° C./hour through the temperature range of from about 727° C. to about 700° C., the size of surface carbides formed on the surface of the strip during box annealing being less than 50 microns.

2. The steel trip of claim 1 wherein the cooling rate as measured on the outer wraps of said coil through the temperature range of from about 727° C. to about 700° C. is at least about 195° C./hour.

3. The steel strip of claim 1 wherein the vanadium content of said casting is at least about 0.015%.

4. The steel strip of claim 3 wherein the vanadium content of said casting is not more than about 0.05%.

5. The steel strip of claim 1 further comprising after heating the strip to a temperature above the $A_1$ and cooling the strip through the temperature range of 727° C. to about 700° C., the steel strip is held at a soak temperature below the $A_1$ temperature for a time until the desired grain size and mechanical properties are obtained.

* * * * *